US008295527B2

(12) United States Patent
Chen

(10) Patent No.: US 8,295,527 B2
(45) Date of Patent: Oct. 23, 2012

(54) MICROPHONE BOOT FOR A PORTABLE ELECTRONIC DEVICE

(75) Inventor: Chao Chen, Waterloo, CA (US)

(73) Assignee: Research In Motion Limited, Waterloo (CA)

( * ) Notice: Subject to any disclaimer, the term of this patent is extended or adjusted under 35 U.S.C. 154(b) by 359 days.

(21) Appl. No.: 12/684,152

(22) Filed: Jan. 8, 2010

(65) Prior Publication Data

US 2011/0170728 A1 Jul. 14, 2011

(51) Int. Cl.
*H04R 25/00* (2006.01)

(52) U.S. Cl. ..... 381/365; 381/306; 381/333; 381/388

(58) Field of Classification Search ..... 381/306, 381/311, 332–336, 338–340, 365, 388; 455/575.1, 455/90.1, 575.5
See application file for complete search history.

(56) References Cited

U.S. PATENT DOCUMENTS

| | | | | |
|---|---|---|---|---|
| 5,204,907 | A | 4/1993 | Staple | |
| 5,491,478 | A | 2/1996 | De La Luz | |
| 5,937,361 | A | 8/1999 | Smith | |
| 6,038,328 | A | 3/2000 | Hsu | |
| 6,163,611 | A | 12/2000 | Patterson et al. | |
| 6,411,709 | B1 * | 6/2002 | Lucey | 379/430 |
| 6,505,076 | B1 * | 1/2003 | Tziviskos et al. | 381/328 |
| 7,302,073 | B2 | 11/2007 | Smith et al. | |
| 7,400,875 | B2 * | 7/2008 | Konno | 381/388 |
| 7,797,025 | B2 * | 9/2010 | Hawker et al. | 455/575.1 |
| 2006/0293091 | A1 | 12/2006 | Hawker et al. | |
| 2007/0116261 | A1 | 5/2007 | Hawker et al. | |
| 2009/0316883 | A1 | 12/2009 | Yang | |

* cited by examiner

*Primary Examiner* — Suhan Ni

(74) *Attorney, Agent, or Firm* — Ridout and Maybee LLP

(57) ABSTRACT

A microphone boot for a portable electronic device and a portable electronic device having such a microphone boot are provided. In accordance with one embodiment, there is provided a portable electronic device, comprising: a printed circuit board (PCB); a microphone attached to the PCB and defining an aperture therein; a frame enclosing the microphone and PCB and defining an opening therein; a cap attached to the frame and defining an aperture therein; and a microphone boot received in the opening in the frame and defining an acoustic channel between the aperture in the microphone and the aperture in the cap.

20 Claims, 8 Drawing Sheets

MICROPHONE BOOT FOR A PORTABLE ELECTRONIC DEVICE

TECHNICAL FIELD

The present disclosure relates to portable electronic devices, and more specifically to a microphone boot for a portable electronic device.

BACKGROUND

Electronic devices, including portable electronic devices, have gained widespread use and may provide a variety of functions including, for example, telephonic, electronic messaging and other personal information manager (PIM) application functions. Some portable electronic devices, such as cellular telephones and smartphones, are equipped with microphones to pick up audio signals from voices and other audio sources.

Microphones are typically contained within portable electronic devices and require an acoustic channel between the exterior of the device and the microphone located within the device. Locating the microphone within portable electronic devices and providing a suitable acoustic channel can be a difficult task due to space restrictions imposed on device components. Accordingly, arrangements which provide a suitable acoustic channel and which satisfy other device constraints, such the location of other device components, device profile and form factor, are desirable.

DETAILED DESCRIPTION OF EXAMPLE EMBODIMENTS

Figure 1:
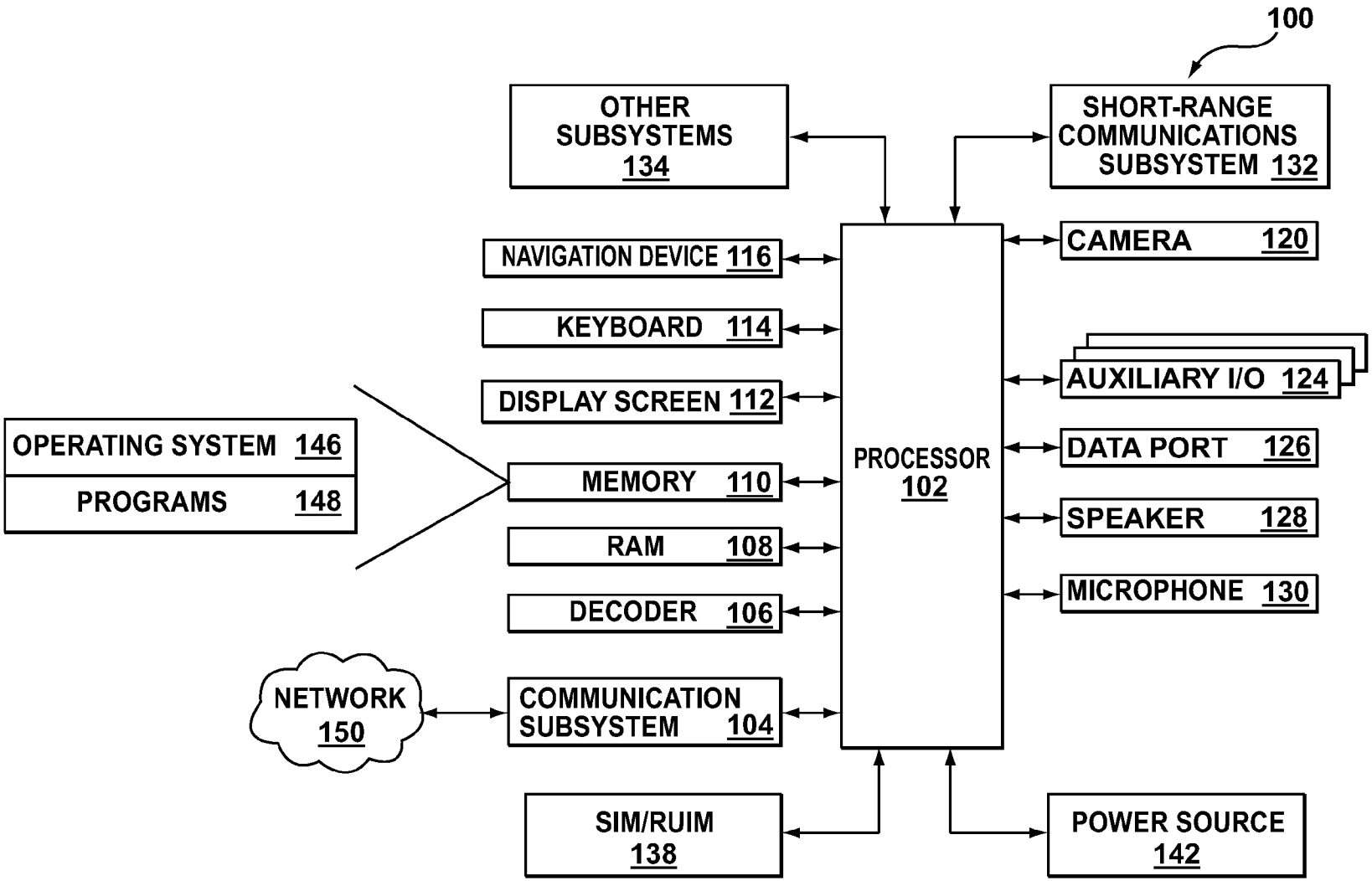
FIG. 1 is a simplified block diagram of components including internal components of a portable electronic device in accordance with one example embodiment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In accordance with one embodiment of the present disclosure, there is provided a portable electronic device, comprising: a printed circuit board (PCB); a microphone attached to the PCB and defining an aperture therein; a frame enclosing the microphone and PCB and defining an opening therein; a cap attached to the frame and defining an aperture therein; and a microphone boot received in the opening in the frame and defining an acoustic channel between the aperture in the microphone and the aperture in the cap.

In accordance with another embodiment of the present disclosure, there is provided a portable electronic device, comprising: a printed circuit board (PCB); a microphone attached to the PCB and defining an aperture therein; a housing defining an aperture therein and enclosing the microphone and PCB; and a microphone boot providing a sealed acoustic channel between the aperture in the microphone and the aperture in the housing.

In accordance with a further embodiment of the present disclosure, there is provided a microphone boot for an electronic device, comprising: a tubular body defining an acoustic channel having apertures at opposite ends thereof; a top flange and a bottom flange located at opposite ends of the tubular body, wherein the apertures of the acoustic channel are located in the top flange and bottom flange, wherein the aperture in the bottom flange has a diameter which is equal to or greater than a diameter of an aperture in a microphone; and sealing members located on the top flange and bottom flange.

In some embodiments of the microphone boot, the sealing members comprise a rib or series of ribs located on outer surfaces of the top flange and bottom flange. The sealing members may comprise a pair of concentric ribs located on outer surfaces of the top flange and bottom flange. The microphone boot may be made of a compressible, non-conductive material such as a compressible, non-conductive rubber. In some embodiments of the microphone boot, the bottom flange is larger than the top flange. In some embodiments of the microphone boot, the acoustic channel defines a conical portion approximate to the top flange and the conical portion narrowing in diameter in a direction extending away from the top flange and towards the bottom flange.

The disclosure generally relates to an electronic device, which is a portable electronic device in the embodiments described herein. Examples of portable electronic devices include mobile, or handheld, wireless communication devices such as pagers, cellular phones, cellular smartphones, wireless organizers, personal digital assistants, wirelessly enabled notebook computers, and so forth. The portable electronic device may also be a portable electronic device without wireless communication capabilities, such as a handheld electronic game device, digital photograph album, digital camera, or other device.

A block diagram of an example of a portable electronic device 100 is shown in FIG. 1. The portable electronic device 100 includes multiple components, such as a processor 102 that controls the overall operation of the portable electronic device 100. Communication functions, including data and voice communications, are performed through a communication subsystem 104. Data received by the portable electronic device 100 is decompressed and decrypted by a decoder 106. The communication subsystem 104 receives messages from and sends messages to a wireless network 150. The wireless network 150 may be any type of wireless network, including, but not limited to, data wireless networks, voice wireless networks, and networks that support both voice and data communications. A power source 142, such as one or more rechargeable batteries or a port to an external power supply, powers the portable electronic device 100.

The processor 102 interacts with other components, such as Random Access Memory (RAM) 108, memory 110, a display screen 112 (such as a liquid crystal display (LCD)), a keyboard 114, a navigation device 116, a digital camera 120, one or more auxiliary input/output (I/O) subsystems 124, a data port 126 (such as a universal serial bus (USB) port), a speaker 128, a microphone 130, short-range communications subsystem 132, and other device subsystems 134. The navigation device 116 may be a depressible/clickable trackball, a depressible/clickable scroll wheel, a touch-sensitive optical trackpad, or a touch-sensitive touchpad. User-interaction with a graphical user interface (GUI) is performed via input devices such as the keyboard 114 and navigation device 116. Information, such as text, characters, symbols, images, icons, and other items that may be displayed or rendered on the portable electronic device, is displayed on the display screen 112 via the processor 102.

The auxiliary I/O subsystems 124 may include one or more of the following: control buttons or keys, a numeric or special function keypad, a touch-sensitive display, a notification light such as a light emitting diode (LED), or a vibrator or other mechanism for providing haptic/touch feedback. In other embodiments, a touch-sensitive display may be provided instead of or in addition to the keyboard 114 and navigation device 116 described above.

To identify a subscriber for network access, the portable electronic device 100 uses a Subscriber Identity Module or a Removable User Identity Module (SIM/RUIM) card 138 for communication with a network, such as the wireless network 150. Alternatively, user identification information may be programmed into memory 110.

The portable electronic device 100 includes an operating system 146 and software applications or programs 148 that are executed by the processor 102 and are typically stored in a persistent, updatable store such as the memory 110. Additional applications or programs 148 may be loaded onto the portable electronic device 100 through the wireless network 150, the auxiliary I/O subsystem 124, the data port 126, the short-range communications subsystem 132, or any other suitable subsystem 134.

A received signal such as a text message, an e-mail message, or web page download is processed by the communication subsystem 104 and input to the processor 102. The processor 102 processes the received signal for output to the display screen 112 and/or to the auxiliary I/O subsystem 124. A subscriber may generate data items, for example e-mail messages, which may be transmitted over the wireless network 150 through the communication subsystem 104. For voice communications, the overall operation of the portable electronic device 100 is similar. The speaker 128 outputs audible information converted from electrical signals, and the microphone 130 converts audible information into electrical signals for processing.

Figure 2:
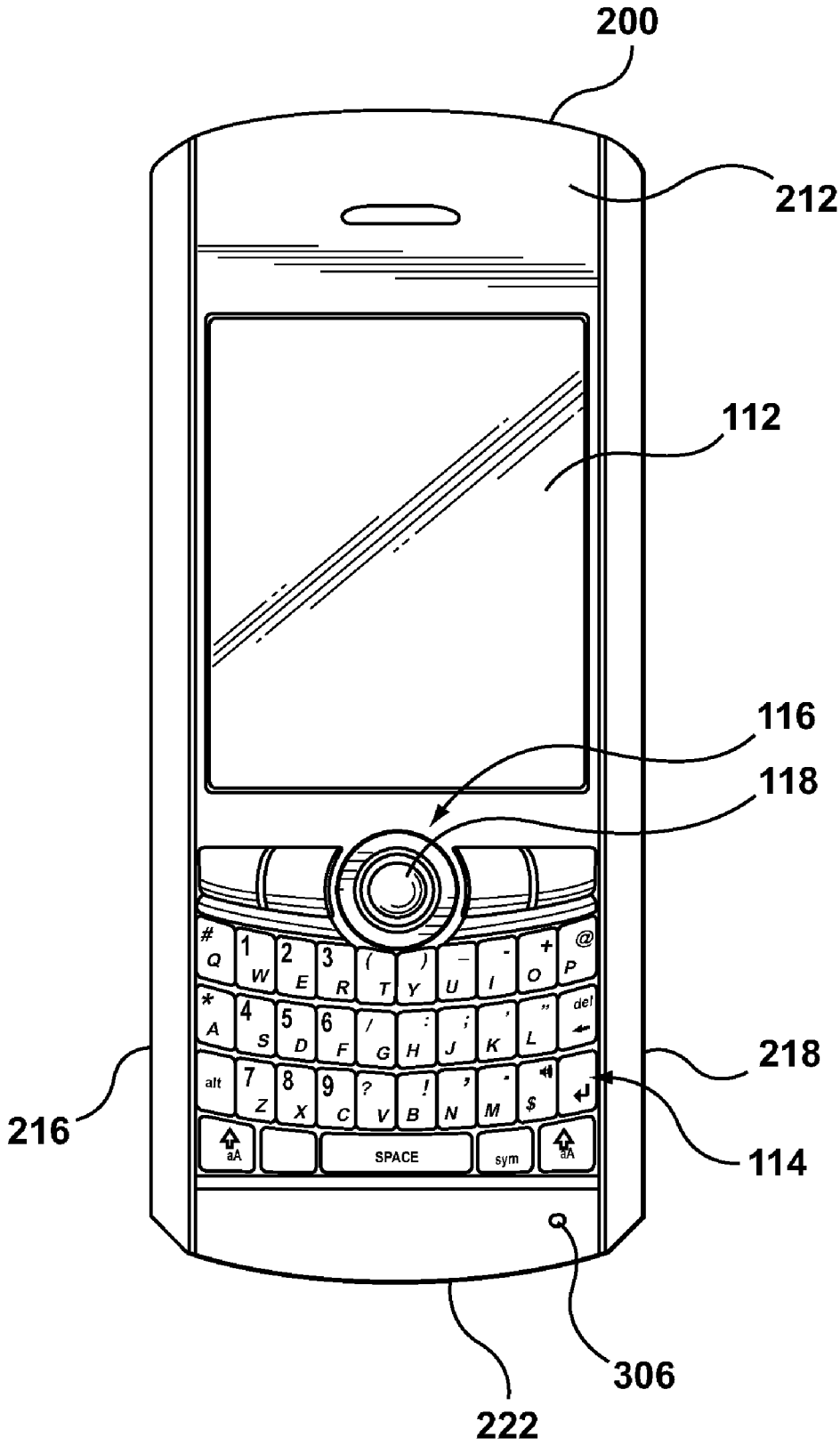
FIG. 2 is a front view of an example embodiment of a portable electronic device in a portrait orientation.

FIG. 2 shows a front view of an example embodiment of the portable electronic device 100 in a portrait orientation. The portable electronic device 100 includes a housing 200 that houses device components including the internal components shown in FIG. 1. The housing 200 frames the display screen 112, keyboard 114 and navigation device 116 so that these components are exposed for user-interaction when the portable electronic device 100 is in use.

Figure 3:
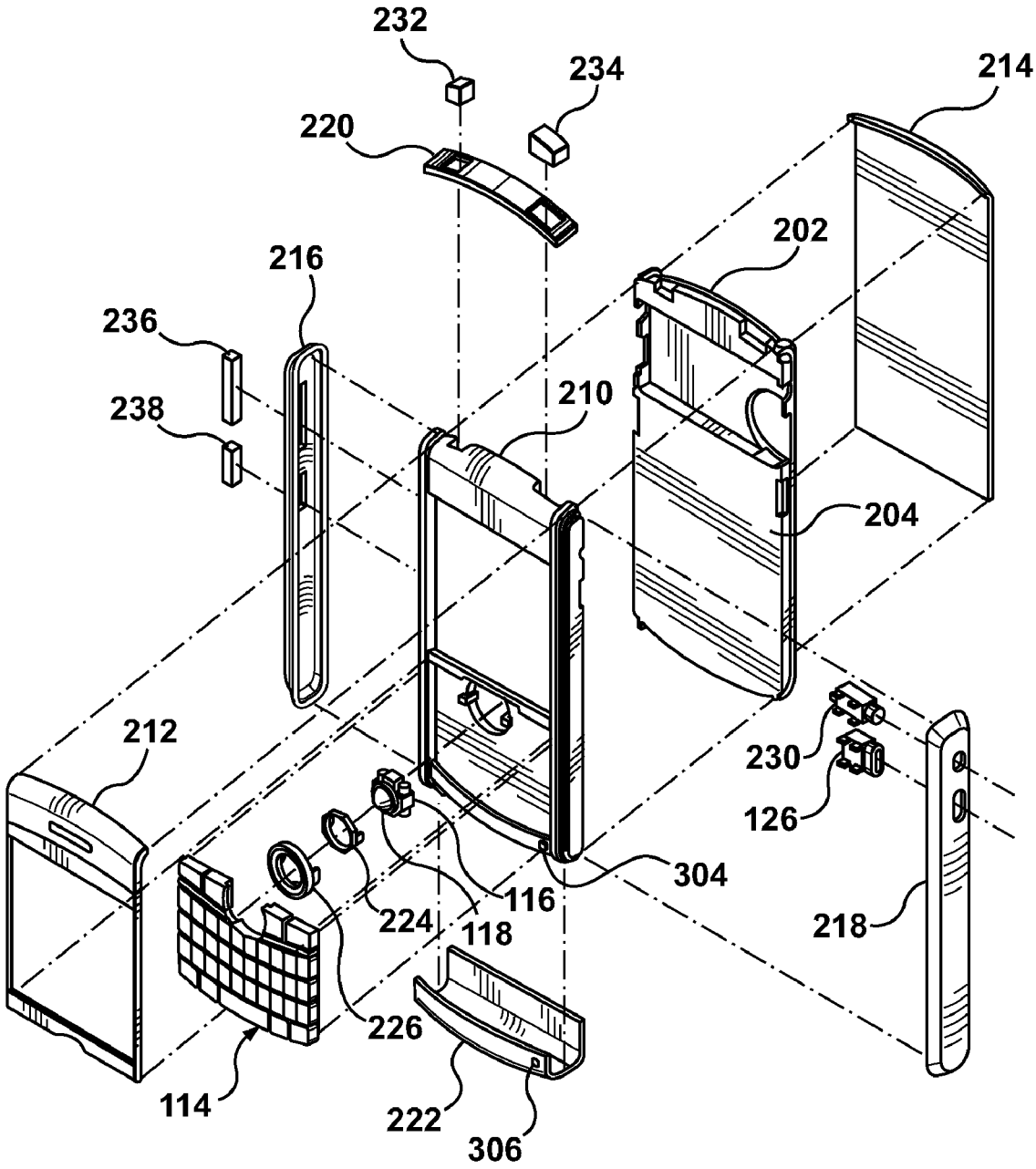
FIG. 3 is an exploded perspective view of the portable electronic device of FIG. 2.
Figure 4:
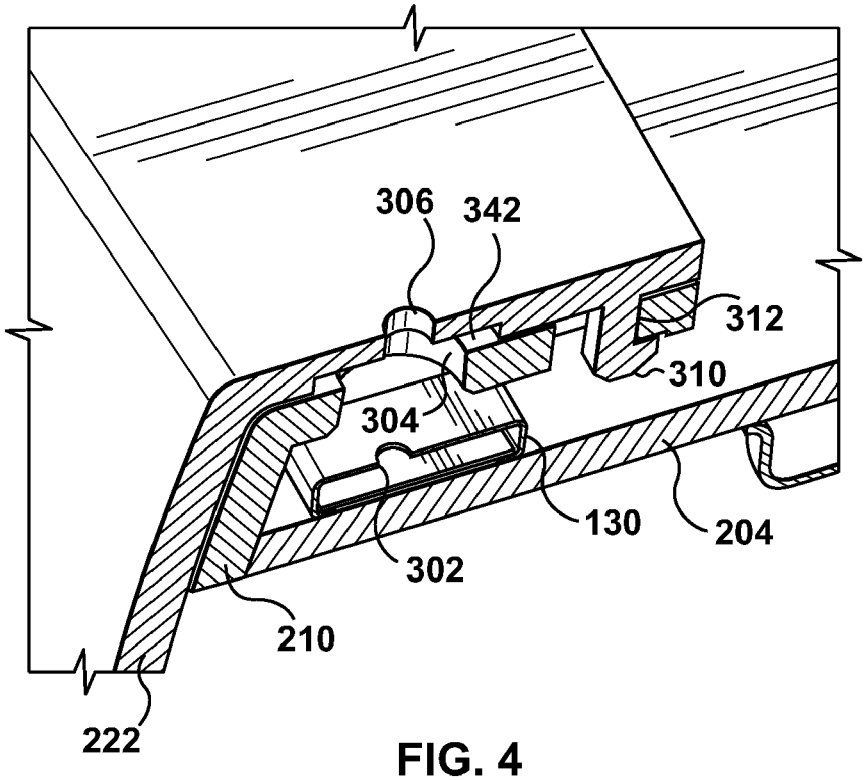
FIG. 4 is a sectional perspective view of a bottom portion of the portable electronic device of FIG. 2 without a microphone boot in accordance with one example embodiment.
Figure 5:
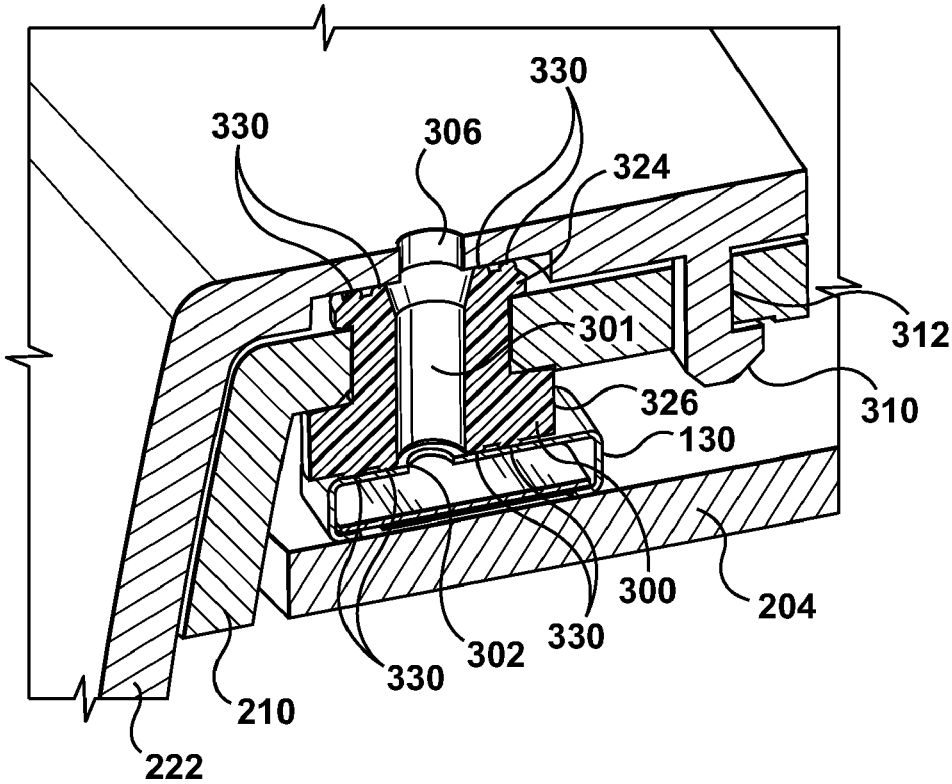
FIG. 5 is a sectional perspective view of the bottom portion of FIG. 4 with a microphone boot.

FIG. 3 shows an exploded perspective view of the portable electronic device 100 shown in FIG. 2. The portable electronic device 100 includes a base or chassis 202 to which the housing 200 and internal components of the portable electronic device 100 are directly or indirectly mounted. The base 202 also provides mechanical support for the portable electronic device 100 and its components. The base 202 can be any suitable base. In the shown embodiment, the base 202 includes a rigid printed circuit board (PCB) 204 which forms a main circuit board of the portable electronic device 100 to which internal components such as those shown in FIG. 1 are mounted. The PCB 204 provides a substrate for mounting and supporting the internal components of the portable electronic device 100 on one or both of its top and bottom sides (depending on the embodiment) and provides some electrical circuitry for the device components, as defined by circuit traces within its various layers. In other embodiments, the base 202 includes a stiffener which supports a flexible PCB which forms the main circuit board of the portable electronic device 100.

The housing 200 can be any suitable housing configured for housing the internal components shown in FIG. 1. The housing 200 is dimensioned to be held with one or two hands while the portable electronic device 100 is in use. In the shown embodiment, the housing 200 comprises a frame 210, a front plate 212 having a lens for protecting the display screen 112, a back plate 214, a left side cap 216, a right side cap 218, a top plate 220, and a bottom cap 222. The directional references used in the present disclosure, such as front, back, left side, right side, top and bottom provide relative positional references for device components for convenience only and are not meant to be limiting, unless otherwise noted.

The frame 210 and back plate 214 extend generally parallel to the base 202. The back plate 214 may include a cover plate (not shown) that is releasably attached for insertion and removal of, for example, the power source 142 and the SIM/RUIM card 138 referred to above. It will be appreciated that the housing 200 may be made of plastic and formed, for example, using injection molded parts. In the example embodiment shown in FIGS. 2 and 3, the frame 210 is generally rectangular with rounded corners although other shapes are possible.

The keyboard 114 and navigation device 116 are connected to the frame 210 and PCB 204 so as to be exposed on the front face of the portable electronic device 100. In the shown embodiment, the navigation device 116 comprises a depressible (or "clickable") rolling member such as a trackball 118 which may be used to move an onscreen position indicator (also known as a caret or focus) through the GUI of the portable electronic device 100. In other embodiments, another type of navigation device 116 may be used such as a depressible/clickable scroll wheel, a touch-sensitive optical trackpad, or a touch-sensitive touchpad. In the shown embodiment, the keyboard 114 is a full keyboard; however, a reduced keyboard could be used in other embodiments.

In the shown embodiment, the navigation device 116 is frictionally engaged within the frame 210. The depressible trackball 118 is held within an opening in the frame 210 through the use of an inner removable ring 224 and outer removable ring 226. The removable rings 224, 226 ensure that the navigation device 116 and its trackball 118 are properly held in place. If desired, the trackball 118 may be removed without removal of the entire navigation device 116. The removal of the trackball 118 is enabled through the use of the outer removable ring 226 and inner removable ring 224.

The data port 126 and a headphone or earphone jack 230 are connected to the PCB 204 and are further held in place by the right side cap 218. Control buttons 232, 234, 236, 238 located on the top and left side of the portable electronic device 100 are also connected to the PCB 204. The control buttons 232, 234 are further held in place by the top plate 220, and the control buttons 236, 238 are further held in place by the left side cap 216. In some embodiments, the control button 232 is a power ON/OFF toggle button, the control button 234 is a speaker mute ON/OFF toggle button, and the control buttons 236 and 238 are volume up and volume down buttons respectively.

Referring now to FIGS. 4 to 12, an arrangement of the microphone 130 and a microphone boot 300 in accordance with one example embodiment will be described. The microphone 130 is shown generally as a rectangular casing having aperture 302 on its top allowing ambient aural signals to be received therethrough and to be processed and converted by its internal components into an electrical signal. The internal components typically comprise a transducer (not shown) for converting ambient aural signals into electrical signals. Electrical contacts for the microphone 130 are generally located on a bottom side of its casing. Corresponding contact pads (not shown) are located on the PCB 204 to separately engage the contacts and complete an electrical circuit to which can be used by other components of the portable electronic device 100. In other embodiments, the microphone 130 may be implemented using a cylinder shaped casing or other suitable casing.

Figure 7:
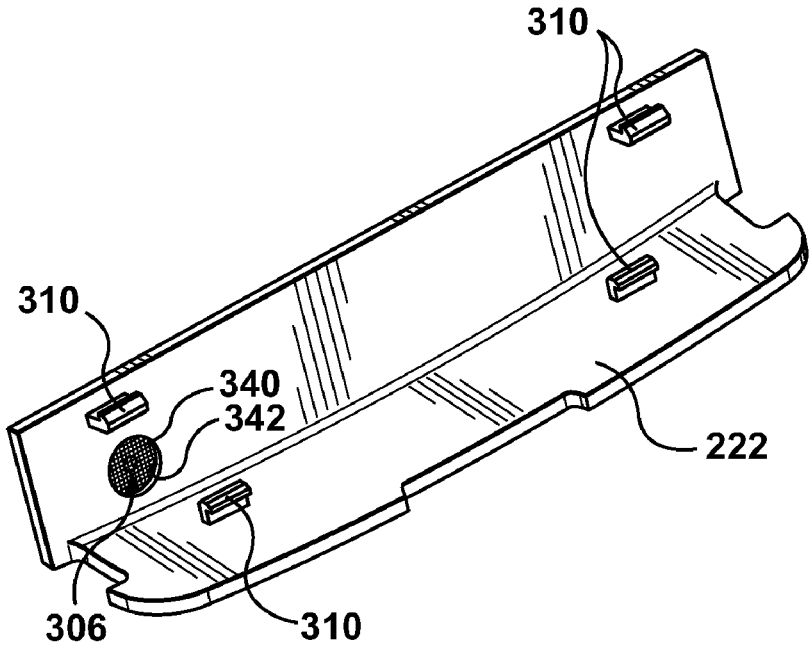
FIG. 7 is a perspective view of a bottom cap for the portable electronic device of FIG. 2 taken from below.
Figure 8:
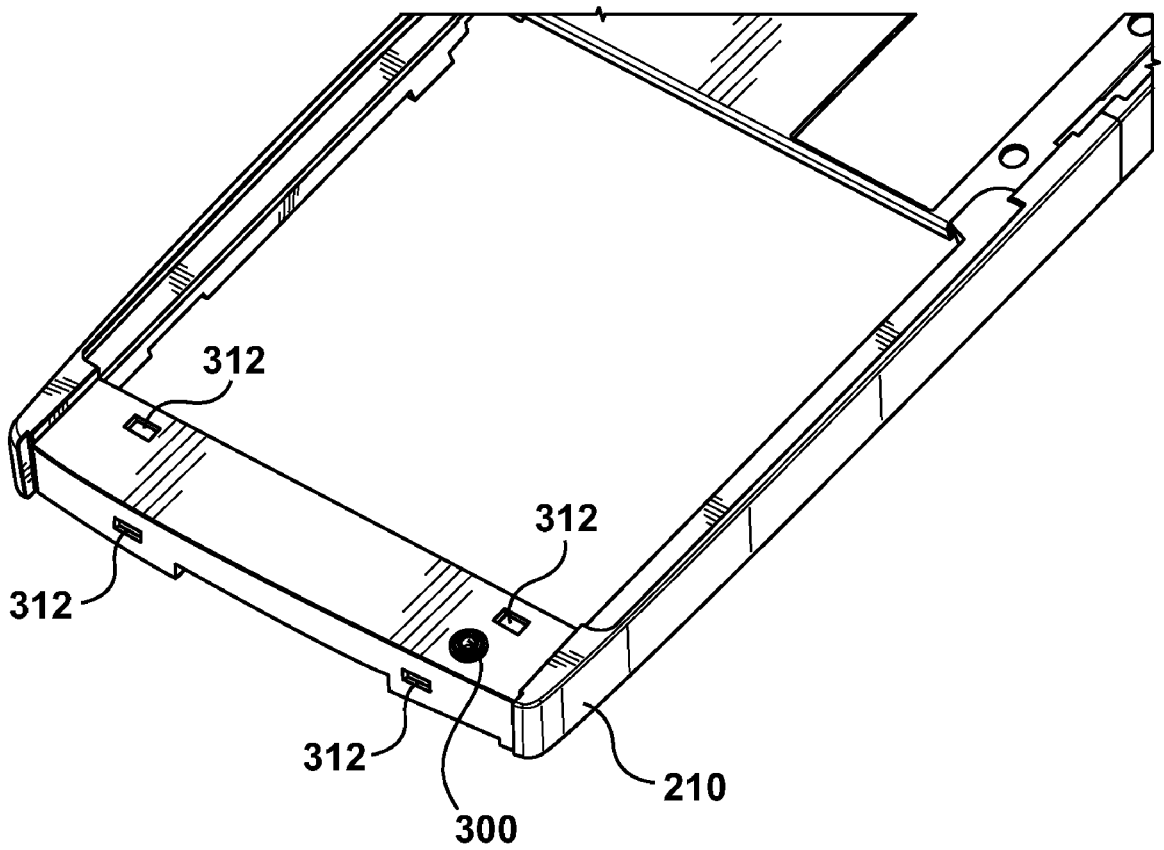
FIG. 8 is a perspective view of a frame for the portable electronic device of FIG. 2 taken from above.
Figure 9:
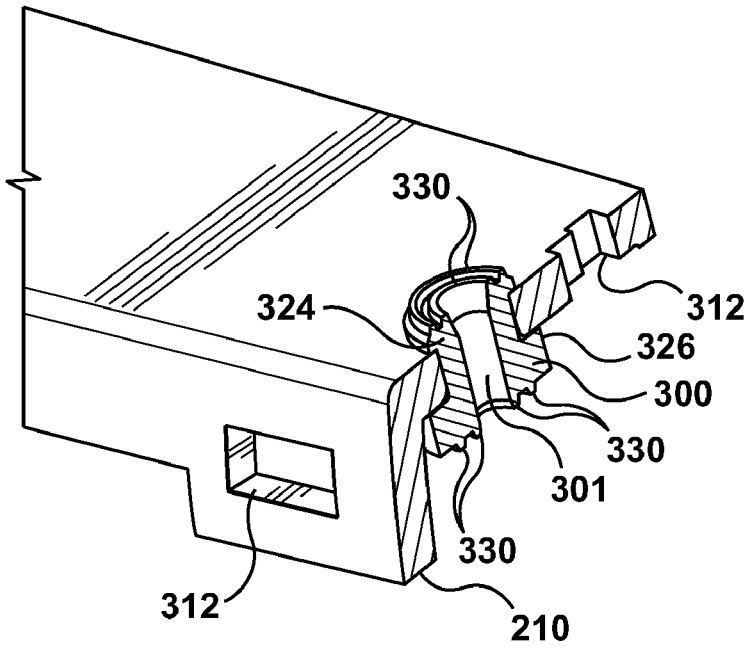
FIG. 9 is an enlarged sectional view of a bottom portion of the frame of FIG. 8 taken along the microphone boot.
Figure 10:
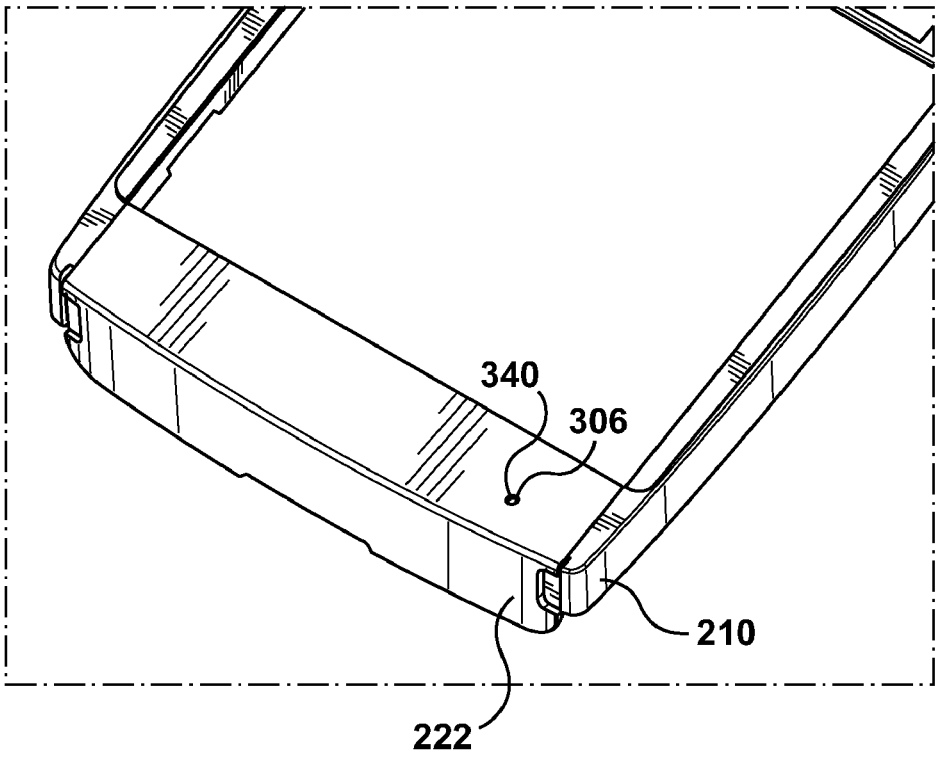
FIG. 10 is a perspective view of the frame of FIG. 8 with the bottom cap of FIG. 7 attached thereto.

The microphone 130 is located below a front portion of the frame 210 towards its bottom. The bottom cap 222 is attached to the front portion of the frame 210 using a set of engageable latches or hooks 310 extending from the inner surface of the bottom cap 222. When bottom cap 222 is fitted with the frame 210, the hooks 310 engage a set of corresponding holes 312 in the frame 210 in a snap-fit arrangement. The hooks 310 and holes 312 are best shown in FIGS. 7 and 8.

The frame 210 defines an opening 304 which is in approximate alignment with the aperture 302 in the top of the microphone 130. Similarly, the bottom cap 222 defines an aperture 306 which is in approximate alignment with the aperture 302 in the top of the microphone 130 and the opening 304 in the frame 210. The microphone boot 300 provides acoustic sealing and vibration isolation for microphone 130 and defines an acoustic channel 301 between the bottom cap 222 and the microphone 130.

The size and shape of aperture 306 in the bottom cap 222 is designed to meet acoustic requirements as needed. In particular, the size should be sufficiently large to allow acoustic signals from the environment (e.g., a user's voice during a voice call or voice recording) to pass into its interior and to reach the microphone 130. However, the size should be sufficiently small to still provide effective protection against foreign objects entering the acoustic channel 301 and to minimize its effect on the appearance of the bottom cap 222. Similarly, the size and shape of aperture 302 in the microphone 130 is designed to meet acoustic requirements as needed, in particular, its size should be sufficiently large to allow acoustic signals from the acoustic channel 301 to reach the transducer of the microphone 130.

The bottom cap 222 is part of the housing 200 described above and covers the frame 210 and any device components mounted in the front of frame 210 in its bottom portion. The bottom cap 222, in some embodiments, is a decorative exterior cap which may include branding information or indicia located on an exterior surface thereof. The branding information may comprise the name and/or logo of a wireless carrier associated with the portable electronic device 100 when the device 100 is a wireless communication device such as a cellular telephone or smartphone.

Figure 6:
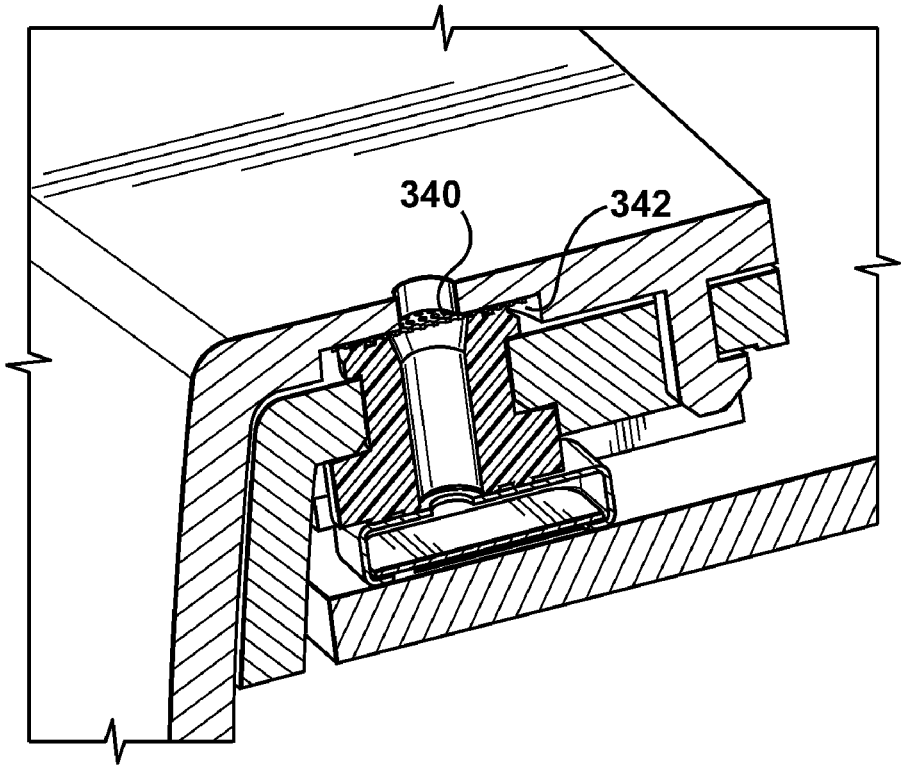
FIG. 6 is a sectional perspective view of the bottom portion of FIG. 5 with a protective mesh located above the microphone boot.

As best shown in FIGS. 6 and 7, in some embodiments a mesh or screen 340 may be provided between the microphone boot 300 and the bottom cap 222. The mesh 340 further protects against foreign objects (e.g., dust and water) entering the acoustic channel 301. In some embodiments, the mesh 340 is, as near as practicable, acoustically transparent so as to avoid affecting the acoustic performance of the microphone 130. The mesh 340 could be made from stainless steel or fabric cloth in some embodiments. The mesh 340 should meet acoustic performance requirements for use with the microphone 130. In the shown embodiment, the mesh 340 is attached to the inner surface of the bottom cap 222 within a concentric recess 342 having the same centre point as the aperture 306 in the bottom cap 222. The recess 342 has a larger diameter than the aperture 306 and defines an area for receiving the mesh 340, and optionally securing the mesh 340 to the inner surface of the bottom cap 222 using a suitable adhesive. Alternatively, the mesh 340 may be secured using a friction fit provided by the microphone boot 300.

Figure 11:
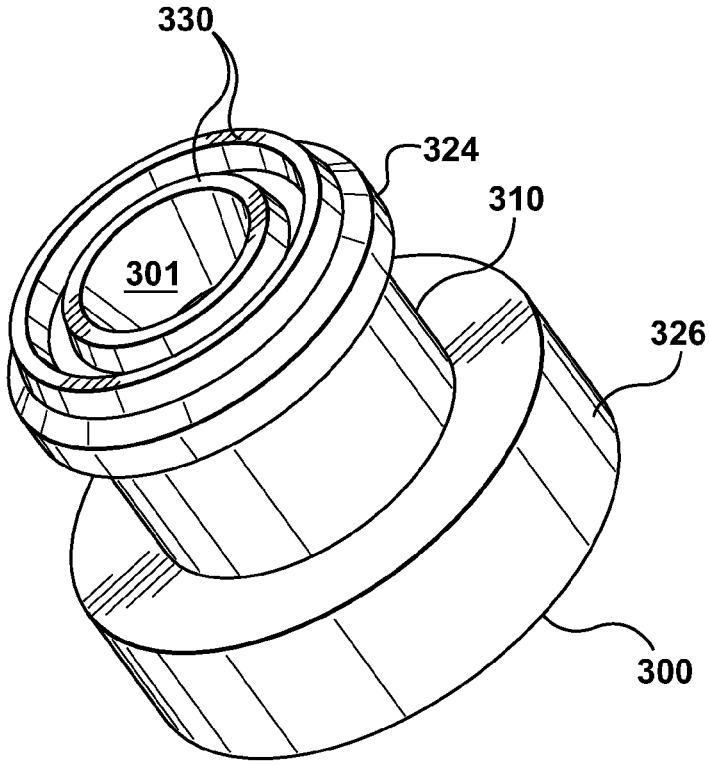
FIG. 11 is a perspective view of a microphone boot for the portable electronic device of FIG. 2 in accordance with one example embodiment.
Figure 12:
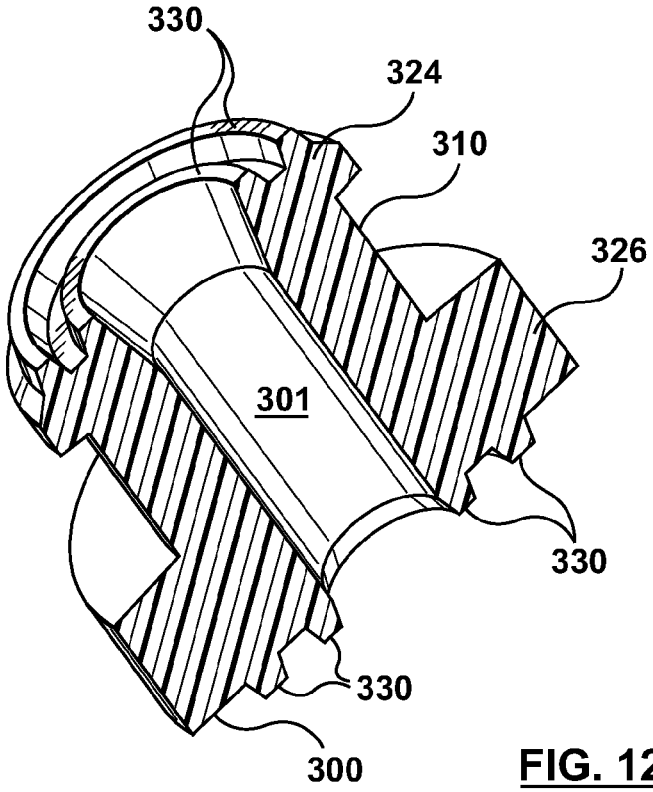
FIG. 12 is a sectional view of the microphone boot of FIG. 11.

Referring to FIGS. 11 and 12, one embodiment of the microphone boot 300 will be described. The microphone boot 300 is made of a compressible, non-conductive material such as a rubber. In some embodiments, the microphone boot 300 is made from a rubber material having a hardness of approximately 45 to 75 shore A hardness. In the shown embodiment, the microphone boot 300 has a generally tubular body 310 with a top flange 324 and bottom flange 326 located at opposite ends of the tubular body 310. The tubular body 310 defines the acoustic channel 301. The top flange 324 and bottom flange 326 allow the microphone boot 300 to be relatively easily installed in the frame 210 using a friction fit while sealing it against the frame 210 and preventing foreign objects from entering the housing 200. The friction fit is described more fully below. The acoustic channel 301 defines a non-linear path which is defined by an annular cavity extending between its opposed flange ends 324, 326. In other embodiments, the microphone boot 300 and acoustic channel 301 could have a different shape.

In the shown embodiment, the acoustic channel 301 defines a conical portion proximate to the top flange 324, the conical portion narrowing in diameter in a direction extending away from the top flange 324 and towards the bottom flange 326 (i.e., in the direction of the microphone 130). The conical portion is located in an outer portion of the acoustic channel 301 facing the bottom cap 222 and is conically shaped so that it narrows in the direction of the microphone 130. The conical portion assists in collecting ambient sound signals from the environment outside of the portable electronic device 100. In other embodiments, the entire acoustic channel 301 may be conically shaped with its diameter narrowing in the direction of the microphone 130.

The microphone boot 300 provides acoustic sealing and vibration isolation for microphone 130. The acoustic channel 301 of the microphone boot 300 defines apertures at its ends. The apertures of the acoustic channel 301 are located in the top flange 324 and bottom flange 326 respectively. The aperture in the bottom flange has a diameter which is equal to or greater than a diameter of the aperture 302 in the microphone 130 so as to reduce interface with ambient sound signals from the environment travelling to the microphone 130. When all elements are assembled, the apertures of the acoustic channel 301 are in approximate alignment with apertures 302 and 306, thereby allowing any ambient sound signals from the environment outside of the portable electronic device 100 to pass through the boot 300 and reach the microphone 130. However, in other embodiments (not shown) the acoustic channel 301 and its various apertures may be shaped and sized to permit the microphone 130 to be offset from the aperture 306 in the bottom cap 222 provided a clear path is provided for the ambient sound to reach microphone 130. In such embodiments, the acoustic channel 301 defines a non-linear path. This may facilitate the location of other device components and provide flexibility in the location and size of the aperture 306 in the bottom cap 222.

The diameter of the opening 304 in the frame 210 may be slightly smaller than the diameter of the tubular body 310 of the microphone boot 300. During assembly, the microphone boot 300 is compressed and inserted into the opening 304 in the frame 210. When the compression forces are removed, the microphone boot 300 expands somewhat and is held in place within the opening 304 using a friction fit such that the top flange 324 is closely fit against an outer surface of the frame 210 and the bottom flange 326 is closely fit against an inner surface of the frame 210. The friction fit may assist in the sealing functions provided by the microphone boot 300. It will also be appreciated that the bottom flange 326 has a diameter larger than the diameter of the top flange 324 as a result of the differences in the size of the opening 304 and the aperture 306 described above.

In at least some embodiments, the microphone boot 300 is configured via its dimensions and shape such that, when the bottom cap 222 is attached to the frame 210, it presses inwardly against and compresses the microphone boot 300 providing inward pressure on microphone 130. In particular, the bottom cap 222 presses against the top flange 324 when the bottom cap 222 is attached to the frame 210. The bottom flange 326, in response, presses against the microphone 130. This configuration provides improved sealing by reducing or eliminating gaps in the acoustic channel 301.

The microphone boot 300 also includes sealing members located on a surface abutting the bottom cap 222 and a surface abutting the microphone 130, in the shown embodiment, the sealing members being located at the flanged ends of the microphone boot 300. The sealing members provide a sealing function between the microphone boot 300 and the bottom cap 222, and between the microphone boot 300 and the microphone 130. The sealing members may be a rib or a series of ribs. In the shown embodiment, the sealing members comprise a pair of concentric ribs 330 located on the outer surfaces of the top flange 324 and bottom flange 326. When a mesh 340 is provided, the concentric ribs 330 of the top flange 324 seal against the mesh 340, typically where the mesh 340 is adhered to the recess 342 of the bottom cap 222, and the concentric ribs 330 on the bottom flange 326 press against the microphone 130. A single concentric rib may be used in other embodiments.

The microphone 130 is radio frequency (RF) shielded to isolate the microphone 130 from electromagnetic interference. Electromagnetic interference may originate from signals received and generated by antennas (not shown) which are part of the communication subsystem 104. In other embodiments, a non-RF shielded microphone could be used in which case an RF shield can (not shown) may be provided to cover the microphone 130 on the PCB 204 to provide an electromagnetic shield to assist in isolating the microphone 130 from electromagnetic interference. RF shield cans are known in the art and so will be described only briefly herein.

An RF shield surrounds the microphone 130 and defines an aperture to allow audio signals entering the aperture 306 in the bottom cap 222 to enter the RF shield can and to pass through to the microphone 130. The size and shape of aperture is designed to meet acoustic and shielding requirements as needed. In particular, the size should be sufficiently small to still provide effective RF shielding, but be sufficiently large to allow acoustic signals to pass into its interior to reach the microphone 130. The aperture in the RF shield can is typically round with a diameter of approximately 1 to 2 mm. The RF shield can is preferably made of metal and is shaped to completely enclose the microphone 130 but for its aperture when microphone 130 is mounted to the PCB 204.

It will be appreciated that in other embodiments, one or more of the above components may be modified in their sizes and shapes to meet specific operational requirements.

The present disclosure describes a microphone boot for a portable electronic device which provides an acoustic channel between the exterior of the device and a microphone located within the device which allows ambient sound signals from the environment outside of the portable electronic device to pass through the microphone boot and reach the microphone. The described microphone boot and a portable electronic device provide an acoustic sealing solution which uses a single acoustic sealing part with can be installed within a housing of the device with relative ease compared with alternative constructions which may require several acoustic sealing parts or use more complex housing constructions. The microphone boot also provides sealing functions by way of sealing members and a friction fit which provide a relatively effective acoustic seal. A mesh is also provided to protect the microphone from foreign objects.

When the device includes a housing including a frame and cap (e.g., branding cap) or faceplate attached to the frame, the microphone boot may be made from a compressible, non-conductive material (such as a compressible, non-conductive rubber) and constructed to have a tubular body with a top flange and a bottom flange located at opposite ends thereof. The microphone boot may be secured within an opening in the frame using a friction fit such that the top flange is closely fit against an outer surface of the frame and the bottom flange is closely fit against an inner surface of the frame. This configuration provides a relatively easy installation of the microphone boot and seals it against the frame thereby preventing foreign objects from entering the housing. The acoustic channel may have a conical portion which assists in collecting ambient sound signals from the environment outside of the portable electronic device. The microphone boot may be configured such that the cap presses inwardly against and compresses the microphone boot providing inward pressure on microphone. In particular, the cap may press against the top flange and the bottom flange presses against the microphone. This configuration provides improved sealing by reducing or eliminating gaps in the acoustic channel. The microphone boot may include sealing members located on the top flange and bottom flange providing a sealing function between the microphone boot and the cap, and between the microphone boot and the microphone.

While the above described embodiments include a frame as part of the housing, it is possible for the frame to be eliminated in other embodiments. In such embodiments, the microphone boot is disposed immediately between the exterior part of the housing (e.g., cap or faceplate) which encloses the microphone and the microphone itself without intervening components. This microphone boot provides a sealed acoustic channel between an aperture in the microphone and an aperture in the housing. The microphone boot may be configured such that the housing presses inwardly against and compresses the microphone boot providing inward pressure on microphone. In particular, the housing may press against the top flange and the bottom flange presses against the microphone. This configuration provides improved sealing by reducing or eliminating gaps in the acoustic channel and eliminating intermediate housing components in the area around the microphone, thereby providing a relatively simple. The microphone boot may be flanged tubular body as in other embodiments, and may include sealing members located on the top flange and bottom flange providing a sealing function between the microphone boot and the housing, and between the microphone boot and the microphone.

The various embodiments presented above are merely examples and are in no way meant to limit the scope of this disclosure. Variations of the innovations described herein will be apparent to persons of ordinary skill in the art. These variations are within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein and in the recited claims intends to cover and embrace all suitable changes in technology.

The invention claimed is:

1. A portable electronic device, comprising:

a printed circuit board (PCB);

a microphone attached to the PCB and defining an aperture therein;

a frame enclosing the microphone and PCB and defining an opening therein;

a cap attached to the frame and defining an aperture therein; and a microphone boot received in the opening in the frame and defining an acoustic channel between the aperture in the microphone and the aperture in the cap.

2. The device of claim 1, wherein the aperture in the microphone and the aperture in the cap are in approximate alignment.

3. The device of claim 1, wherein the acoustic channel of the microphone boot defines apertures at its ends, wherein the apertures of the acoustic channel are in approximate alignment with aperture in the microphone and the aperture in the cap.

4. The device of claim 1, wherein the microphone boot has a tubular body with a top flange and a bottom flange located at opposite ends thereof.

5. The device of claim 4, wherein the microphone boot is made of a compressible, non-conductive material and is secured within the opening in the frame using a friction fit such that the top flange is closely fit against an outer surface of the frame and the bottom flange is closely fit against an inner surface of the frame.

6. The device of claim 1, wherein the microphone boot is configured such that the cap presses inwardly against and compresses the microphone boot providing inward pressure on the microphone.

7. The device of claim 4, wherein the cap presses against the top flange and the bottom flange presses against the microphone.

8. The device of claim 4, wherein the microphone boot includes sealing members located on the top flange and bottom flange.

9. The device of claim 8, wherein the sealing members comprise a rib located on outer surfaces of the top flange and the bottom flange.

10. The device of claim 8, wherein the sealing members comprise a pair of concentric ribs located on outer surfaces of the top flange and the bottom flange.

11. The device of claim 1, further comprising a mesh located between the microphone boot and the cap.

12. The device of claim 11, wherein the mesh is received within a recess defined in an inner surface of the cap, wherein the microphone boot is configured such that the cap presses inwardly against and compresses the microphone boot providing inward pressure on the microphone, wherein concentric ribs on a top flange of the microphone boot press against the mesh and concentric ribs on a bottom flange of the microphone boot press against the microphone.

13. The device of claim 1, wherein the microphone boot includes sealing members located on a surface abutting the cap and a surface abutting the microphone.

14. The device of claim 4, wherein the acoustic channel defines a conical portion approximate to the top flange, the conical portion narrowing in diameter in a direction extending away from the top flange and towards the bottom flange.

15. A microphone boot comprising:

a tubular body defining an acoustic channel having apertures at opposite ends thereof;

a top flange and a bottom flange located at opposite ends of the tubular body, wherein the apertures of the acoustic channel are located in the top flange and bottom flange, wherein the aperture in the bottom flange has a diameter which is equal to or greater than a diameter of an aperture in a microphone; and sealing members located on the top flange and bottom flange.

16. The microphone boot of claim 15, wherein the sealing members comprise a rib located on outer surfaces of the top flange and bottom flange.

17. The microphone boot of claim 15, wherein the microphone boot is made of a compressible, non-conductive material.

18. The microphone boot of claim 15, wherein the bottom flange is larger than the top flange.

19. The microphone boot of claim 15, wherein the acoustic channel defines a conical portion approximate to the top flange, the conical portion narrowing in diameter in a direction extending away from the top flange and towards the bottom flange.

20. A portable electronic device, comprising:

a printed circuit board (PCB);

a microphone attached to the PCB and defining an aperture therein;

a housing defining an aperture therein and enclosing the microphone and PCB; and a microphone boot providing a sealed acoustic channel between the aperture in the microphone and the aperture in the housing.

* * * * *